US006874763B2

(12) United States Patent
Sozzi

(10) Patent No.: US 6,874,763 B2
(45) Date of Patent: Apr. 5, 2005

(54) DRIVING DEVICE FOR THE TRACTION OF CABLES OR CHAINS

(75) Inventor: Chiara Sozzi, Via Donizzetti 34, I-20122 Milan (IT)

(73) Assignees: Chiara Sozzi, Milan (IT); part interest; Lofrans' S.R.L., Monza-Milan (IT); part interest ( * ) Notice: Subject to any disclaimer, the term of this patent is extended or adjusted under 35 U.S.C. 154(b) by 0 days.

(21) Appl. No.: 10/258,306

(22) PCT Filed: May 16, 2001

(86) PCT No.: PCT/EP01/05703

§ 371 (c)(1),
(2), (4) Date: Oct. 23, 2002

(87) PCT Pub. No.: WO01/87763

PCT Pub. Date: Nov. 22, 2001

(65) Prior Publication Data

US 2003/0107030 A1 Jun. 12, 2003

(30) Foreign Application Priority Data

May 18, 2000 (IT) ..... MI2000A1105

(51) Int. Cl.[7] ..... B66D 1/26
(52) U.S. Cl. ..... 254/278; 254/316

(58) Field of Search ..... 254/267, 278, 254/394, 314, 315, 316, 362, 358, 372

(56) References Cited

U.S. PATENT DOCUMENTS

| | | | | | |
|---|---|---|---|---|---|
| 2,455,917 | A | * | 12/1948 | Crake | 254/267 |
| 2,462,484 | A | * | 2/1949 | Fox | 254/340 |
| 3,102,434 | A | * | 9/1963 | Cramer et al. | 477/110 |
| 3,836,121 | A | * | 9/1974 | Jones | 254/340 |
| 4,475,163 | A | | 10/1984 | Chandler et al. | |
| 4,636,962 | A | | 1/1987 | Broyden et al. | |
| 5,044,608 | A | * | 9/1991 | Hidaka et al. | 254/266 |
| 5,271,608 | A | | 12/1993 | Kubono | |
| 5,632,469 | A | * | 5/1997 | Heun et al. | 254/267 |
| 6,595,493 | B2 | * | 7/2003 | Krebs et al. | 254/266 |

FOREIGN PATENT DOCUMENTS

DE 28 40 801 4/1980

* cited by examiner

*Primary Examiner*—Emmanuel Marcelo
(74) *Attorney, Agent, or Firm*—Hedman & Costigan, P.C.

(57) ABSTRACT

An improved driving device (10) for the traction of cables or chains, in particular a device (1) for driving electric anchor winches (15), electric winches or windlasses (24), which are able to drive boat or ship anchors.

9 Claims, 3 Drawing Sheets

DRIVING DEVICE FOR THE TRACTION OF CABLES OR CHAINS

The present application claims priority to Italian Patent Application Serial No. MI2000A001105, filed May 18, 2000 and PCT/EP01/05703, filed May 16, 2001.

BACKGROUND OF THE INVENTION

This invention relates to a improved driving device for the traction of cables or chains, usable in particular to drive electric anchor winches, electric winches or windlasses.

Anchor winches are used to operate the anchors of boats and ships; they may be of the vertical-axis (capstan) or horizontal-axis (windlass) type, and are usually driven by an electric or hydraulic motor. The chain or cable is wound for about half a turn round the "wildcat" of the winch and then descends into the chain locker; in addition to the wildcat, the motor activates a barrel designed to operate the cables, which is positioned on the same axis as the wildcat in the case of capstan winches and on an axis with equal or faster rotation in the case of windlasses.

The wildcat is connected to the drive shaft by a mechanical coupling, the insertion of which is facilitated by a clutch; in order to control the movement of the wildcat when it remains idle, a band brake is fitted to reduce the descent speed of the anchor and cut off the motor, if necessary.

In addition, the direction of rotation of the motor can always be reversed and, in the case of windlasses, the anchors can even be operated one at a time, by uncoupling the wildcat of the anchor which is not to be moved, and locking it with the brake. Winches are usually proportioned to weigh the two anchors simultaneously and break out (release from the sea bed, by reference to a conventional depth of two chain shackles) one anchor at a time. Anchor winches are usually driven by electric motors, commonly regulated by the Ward-Leonard system, electronic systems or the like, in order to reduce speed at the time of breaking out.

Alternatively, purely electric winches are used for traction which are fitted with a directly coupled electric motor that forms a single assembly with the winch. In this case, coupling for low powers is effected by mounting a sprocket wheel on the drive shaft, while for high powers, a flexible coupling is fitted, the outer band of which acts as a brake pulley; the direction is reversed by automatic control or remote controls using contactors.

The operating mechanism of each winch comprises a set of safety devices (ratchet gears, automatic brakes) which prevent spontaneous rotation and unwinding of cables or chains under the action of the load when the drive action ceases.

In any event, the electrical circuit which powers conventional winches is always complex, especially because the battery of the boat, which is normally located dozens of metres from the anchor winch, needs to be connected both to the winch motor (electric or hydraulic) and to its drive relays.

In addition, as ancillary drive controls (such as a lever or pedal control) are generally used, together with other service devices (length sensors and pushbutton panels with length counters) and emergency devices, the installation of the entire electrical operating circuit obviously becomes increasingly complicated due to the large number of connection cables and the special features of the various connections to be made.

SUMMARY OF THE INVENTION

The object of this invention is therefore to provide an improved driving device for the traction of cables or chains with eliminates the drawbacks mentioned above, i.e., provides a safe drive device which is easy to install at very low cost, compared with conventional drive devices.

Another object of this invention is to make a improved driving device for the traction of cables or chains, in particular for driving anchor winches, electric winches or windlasses, which does not need to be assembled by particularly skilled personnel.

A further object of this invention is to provide a improved driving device for the traction of cables or chains which allows the use of shorter connections than conventional devices, thus reducing voltage drops along the route of the electric wiring.

Last but not least, the object of this invention is to provide a improved driving device for the traction of cables or chains, in particular to drive anchor winches, electric winches or windlasses, which is simple and cheap to make, using simple technologies and relatively inexpensive raw materials and components, while using the same accessories and emergency devices as known drive devices.

These and other purposes are achieved by a improved driving device for traction of cables or chains usable to drive electric anchor winches (15), electric winches (24) or windlasses, which are suitable to drive at least one boat or ship anchor, of the type comprising at least one power source (40) which supplies energy via first connection cables (P) to at least one motor (23A, 23B), and at least one control unit (52, 53) or display unit (54) which is connected to said motor (23A, 23B) via second connector cables (S), which said motor (23A, 23B) is also connected to at least one anchor drive unit (45, 46), wherein said drive units (45, 46) are located inside said motor (23B) of said anchor winches (15), electric winches (24) or windlasses.

Advantageously, the device to which this invention relates produces a far higher winch descent speed than conventional devices, and an ascent speed which is independent of the weight of the anchor and the length of chain released. In particular, the "free-fall" effect, which is very dangerous for users, is eliminated, and there is no need for crew members to go to the bow to release the anchor quickly; in addition, better control during the operations makes the drive system highly reliable and eliminates the risk that the deck of the boat will be damaged by the anchor if it is weighed too fast. The simpler assembly, which is the main feature of this invention, also relates to ancillary units such as the length sensor of the anchor winch, which can be installed in a protected area rather than on the exterior, directly on the wildcat, as in the case of existing devices; as a result, this delicate electronic unit does not need to come into contact with the seawater normally raised by the winch chain.

Finally, this invention offers immediate operation and more precise measurement of the number of turns of the chain, as this parameter is measured prior to the reduction gear.

Other ancillary and emergency units allow the anchor to be weighed even in the event of malfunction of the ascent contactor, provide additional controls, signal critical situations of the motor and allow the connection of remote controls to the motor.

BRIEF DESCRIPTION OF THE DRAWINGS

The characteristics and advantages of a improved driving device for the traction of cables and chains, in particular for driving anchor winches, electric winches or windlasses, in accordance with this invention, will become even clearer from the following description, which relates to a form of embodiment illustrated by way of example but not of limitation by reference to the schematic drawings annexed, in which.

DETAILED DESCRIPTION OF THE INVENTION

Figure 1:
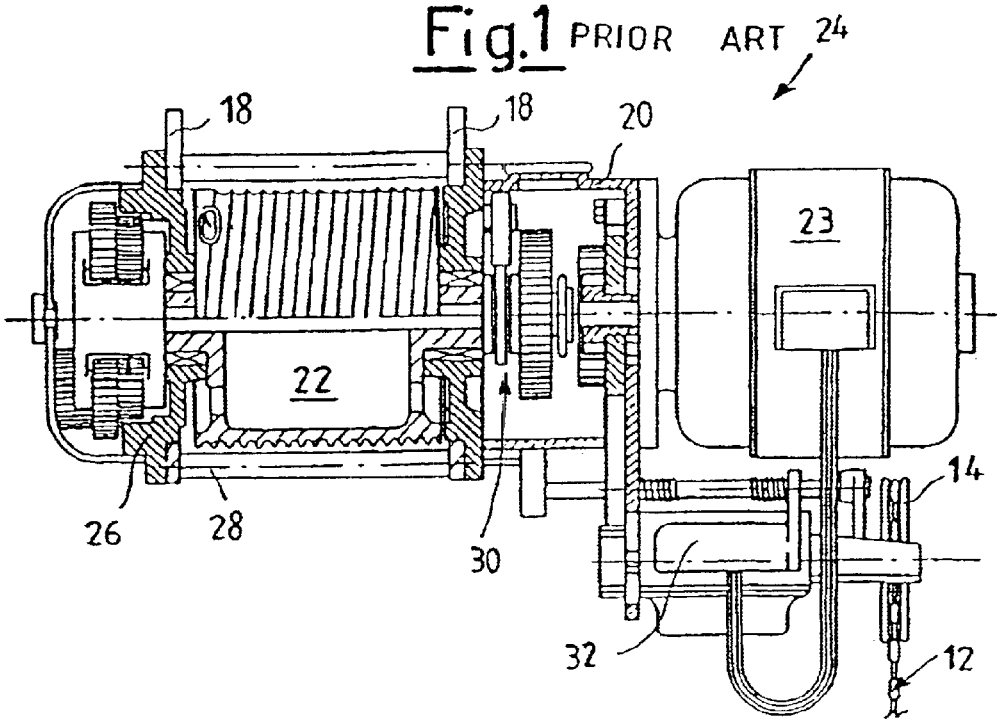
Fig.1 PRIOR ART
FIG. 1 illustrates a windlass of known type.
Figure 1A:
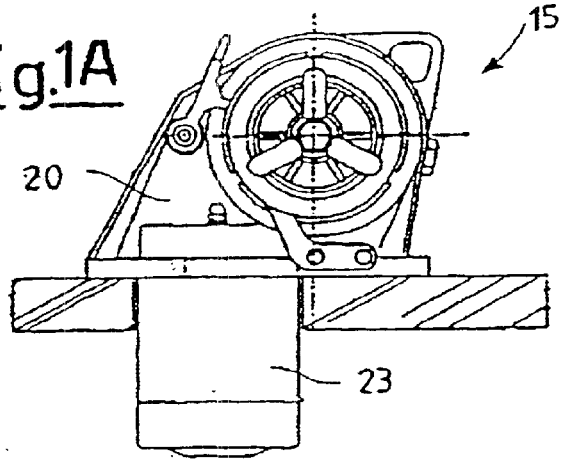
Fig.1A PRIOR ART
FIGS. 1A–1F schematically represent the front and side views of three electric winches now in production.
Figure 1B:
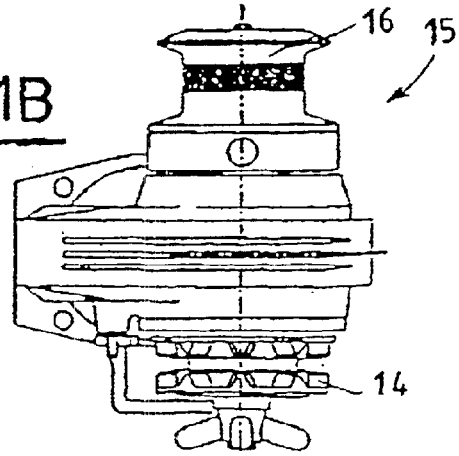
Fig.1B PRIOR ART
Figure 1C:
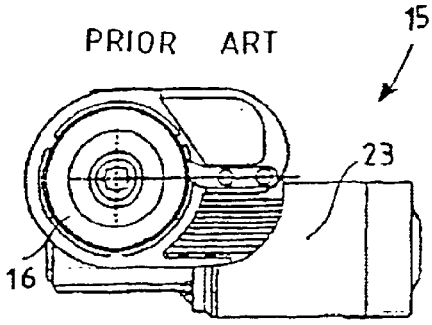
Fig.1C PRIOR ART
Figure 1E:
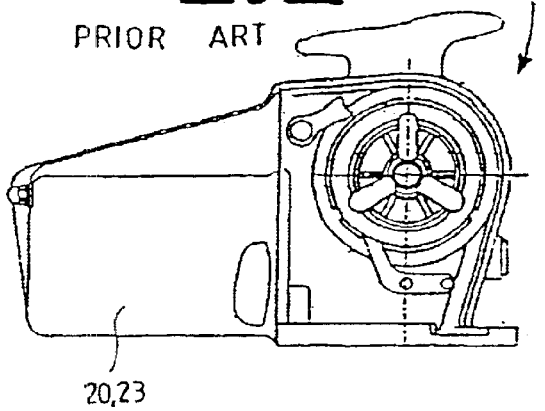
Fig.1E PRIOR ART
Figure 1D:
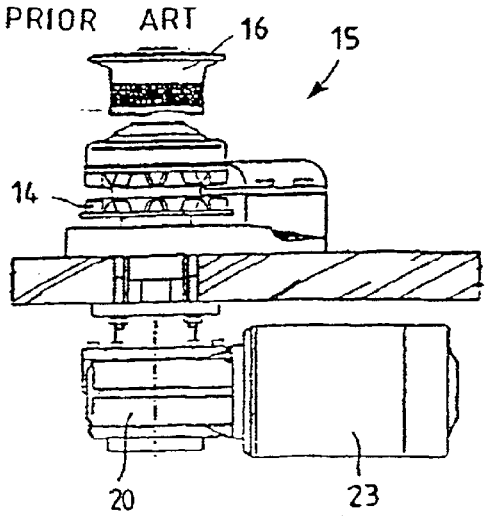
Fig.1D PRIOR ART
Figure 1F:
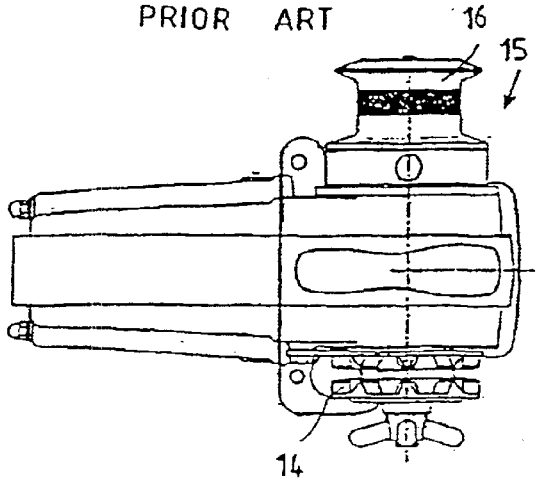
Fig.1F PRIOR ART

With particular reference to FIGS. 1 and 1A–1F, no. 12 generically indicates a chain designed to wind for about half a turn around the wildcat 14 and then descend into the chain locker, while 16 indicates a barrel which serves to drive the cables, which is positioned on the same axis as wildcat 14 and driven by the same (electric or hydraulic) motor that drives winch 15. No. 18 indicates a series of cable fixing rings, 20 a gear casing, 22 a drum, 23 a directly coupled electric motor which forms a single assembly with electric winch 24, 26 a rear gear casing, 28 a connector casing, 30 a brake and 32 a speed changer designed to rotate wildcat 14 around which is wound chain 13, which is attached to the anchors.

Figure 2:
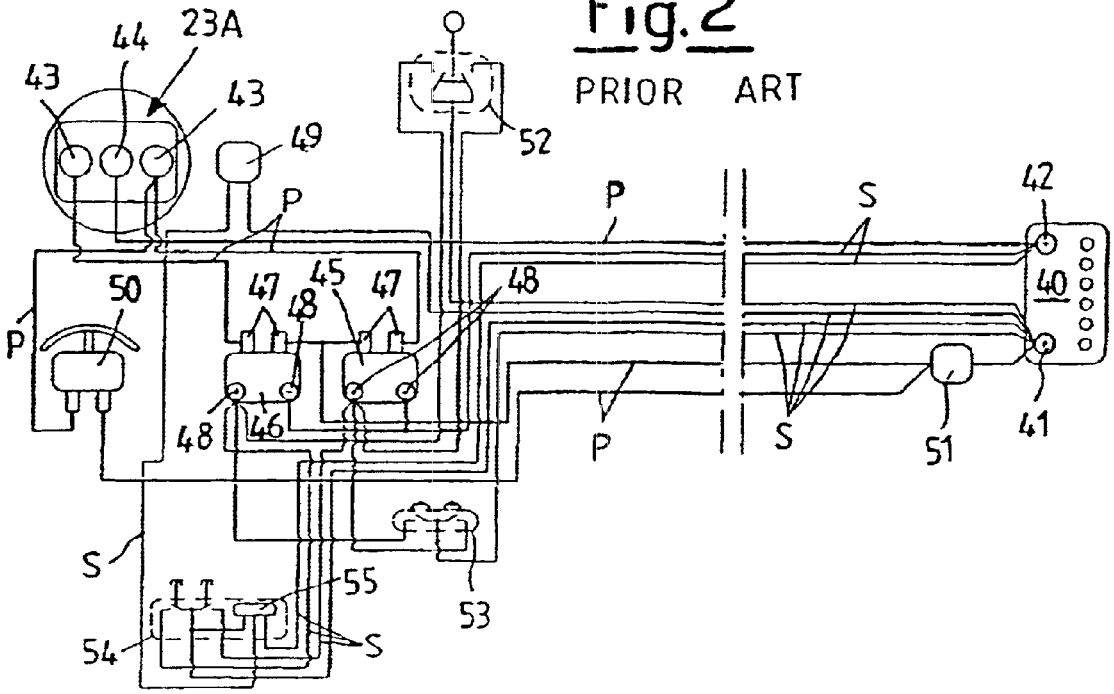
Fig.2 PRIOR ART
FIG. 2 illustrates the wiring diagram of an improved driving device for the traction of cables and chains, of known type.
Figure 3:
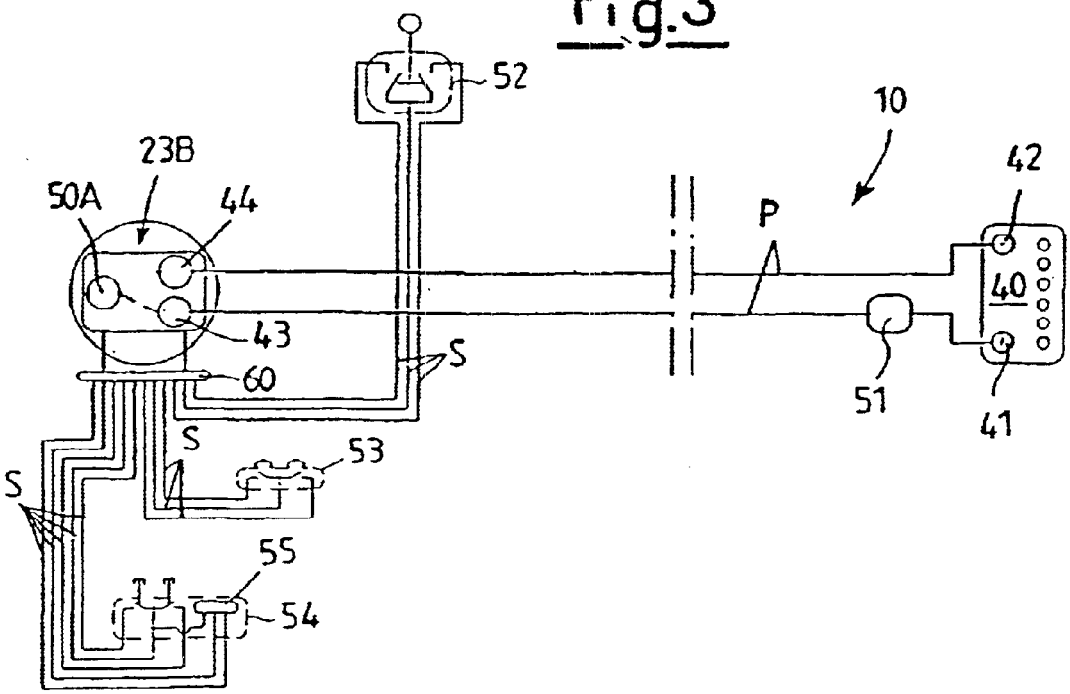
FIG. 3 illustrates the wiring diagram of an improved driving device for the traction of cables and chains, in particular for driving anchor winches, electric winches or windlasses, designed to operate boat or ship anchors, in accordance with this invention.

With special reference to FIGS. 2 and 3, the bold lines marked P generically indicate power cables, while the thinner lines marked S generically indicate cables destined to connect service units; these figures refer specifically to anchor winch drives of the type shown in FIGS. 1A–1F and indicated as no. 15, in which the (electric or hydraulic) motor is usually located outside the anchor-weighing unit as described above; however, this invention is equally applicable to electric winches 24 (FIG. 1) in which electric motor 23 is directly connected to the anchor-weighing unit. In particular, in FIG. 2, no. 40 indicates a storage battery which powers the drive device, the positive and negative poles of which are indicated as 41 and 42 respectively, while 23A indicates an electric motor, 43 and 44 the positive and negative terminals of the electric motor, 45 and 46 the up and down anchor drive relays respectively, and 47 and 48 the connector terminals of power lines P and service lines S respectively. Finally, no. 49 indicates a length sensor device, 50 an emergency relay, 51 a thermomagnetic switch which indicates overheating of the system, 52 generically indicates a lever control of anchor winch 15, 53 a pedal control, and 54 a service pushbutton panel with built-in length-counter device 55.

FIG. 3 illustrates a drive device in accordance with this invention, generically indicated as no. 10, in which the reference numbers equal to those shown in FIG. 2 indicate the same components, as those shown in FIG. 2, which perform the same functions.

As shown in FIG. 3, storage battery 40 is connected to terminals 43, 44 of motor 23B, which may be electric or hydraulic, solely via power cables P, which extend for a length ranging between 10 and 50 meters, while drive relays or contactors 45, 46 are wholly incorporated in motor 23B, so that further units 52, 53 and 54 can be connected to motor 23B merely by connecting them to the corresponding predefined outputs of terminal 60.

For the sake of completeness it should be mentioned, by way of example but not of limitation, that the drive units used in the device may consist of relays, contactors, MOS units or "four-quadrant" units.

The fact that the drive devices are incorporated inside motor 23B is particularly advantageous for installers, because it is sufficient to insert the terminals of the various control units 52, 53 and ancillary units 54, 55 in the predefined positions of terminal 60, with no need to make numerous connections or to devote great attention to the wiring.

In this case, to ensure correct installation, it is sufficient to power the device by connecting terminals 41, 42 of battery 40 with power cables P to terminals 43, 44 of motor 23B in the correct polarity, and then connect service cables S to common terminal 60 which is designed for the connection of remote controls; as a result, the entire wiring system is greatly simplified, and can therefore be performed by the boat manufacturer with no need for highly skilled personnel.

All this also means a considerable, advantageous reduction in manufacturing and running costs (because wiring costs are eliminated), immediate operation, and an equally advantageous reduction in the voltage drops (amounting to some 3–4 volts out of the available total of 12 volts) which can occur in the connector cables, since the wires are much shorter than in conventional drive devices.

Another highly advantageous technical feature of the drive device in accordance with the invention is that length sensor 49 is incorporated inside motor 23B; this again means a substantial reduction in the assembly costs of sensor 49 and the associated wiring compared with known devices, and simpler assembly of sensor 49 which, in the case of this invention, is installed in a very safe position, unlike the prior art, according to which sensor 49 is usually positioned outside motor 23A, directly on wildcat 14 of anchor winch 15, and therefore exposed to the seawater usually raised by chain 12. As a result, immediate operation is obtained, together with more precise measurement by sensor 49, which is based on the number of revolutions prior to reduction gear 32.

In addition, an emergency device 50A is installed inside motor 23B instead of the conventional external relay, indicated as no. 50 in FIG. 2. This emergency device 50A compensates for any breakdowns of device 10, and in particular possible malfunctions of ascent contactor 45, so as to constitute an additional anchor-weighing control if such malfunctions should occur. As already mentioned, in addition to anchor winch 15, the device to which this invention relates can be applied to an electric winch 24; in this case, as the anchor-weighing device is directly connected to electric operating motor 23, the same advantages as provided by this invention will be obtained, obviously in the same way, by incorporating the drives directly inside the anchor-weighing device and installing minimal connecting wiring between the drives and electric motor 23 of winch 24.

What is claimed is:

1. Improved driving device (10) for the traction of cables or chains, usable to drive electric anchor winches (15), electric winches (24) or windlasses, which are suitable to drive at least one boat or ship anchor, of the type comprising at least one power source (40) which supplies energy via first connection cables (P) to at least one motor (23A, 23B), and at least one control unit (52, 53) or display unit (54) which is connected to said at least one motor (23A, 23B) via second connector cables (S), said motor (23A, 23B) being connected to at least one up and down anchor drive relay unit (45, 46), wherein said at least one up and down anchor relay drive unit (45, 46) is incorporated inside said electric anchor winches (15), electric winches (24) or windlasses.

2. Improved driving device (10) for the traction of cables or chains, usable to drive electric winches (24) which are suitable to operate at least one boat or ship anchor, of the type comprising at least one power source (40) which supplies energy via first connection cables (P) to at least one electric motor (23A, 23B), and at least one control unit (52, 53) or display unit (54) which is connected to the said at least one electric motor (23A, 23B) via second connector cables (S), said at least one electric motor (23A, 23B) being also connected to at least one up and down anchor relay drive unit (45, 46), wherein said up and down anchor relay drive unit (45, 46) is incorporated inside said electric winches (24) and connected to said at least one electric motor (23A, 23B) of said electric winches (24).

3. Improved driving device (10) as claimed in claim 1, wherein emergency units (50, 50A), are activated in the event of malfunction of said at least one up and down anchor relay drive unit (45, 46), and at least one length sensor (49) are also fitted inside the said at least one motor (23B).

4. Improved driving device (10) as claimed in claim 1, wherein said at least one control unit (52, 53) or display unit (54) comprise at least one lever control, at least one pedal control and at least one pushbutton panel with a length-counting device.

5. Improved driving device (10) as claimed in claim 1 wherein said at least one up and down anchor relay drive unit (45, 46) comprise relays, contractors, MOS units or four-quadrant units.

6. Improved driving device (10) as claimed in claim 1, further comprising at least one common terminal (60) at the output of said at least one electric motor (23B), designed for connection of remote control units (52, 53) or remote signaling units (54).

7. Improved driving device (10) as claimed in claim 1, wherein said at least one motor (23A, 23B) is an electric motor.

8. Improved driving device (10) as claimed in claim 7, further comprising at least one heat sensor (51) designed to signal malfunctions of the said at least one motor (23A, 23B).

9. Improved driving device (10) as claimed in claim 1, wherein said at least one motor (23A, 23B) is a hydraulic motor.

* * * * *